United States Patent [19]

Sato et al.

[11] 3,981,608

[45] Sept. 21, 1976

[54] TURBINE CONTROL SYSTEM

[75] Inventors: Seiko Sato, Tokyo; Yutaka Hiyama, Higashiyamato; Mitsuhisa Yokota, Yokohama, all of Japan

[73] Assignee: Tokyo Shibaura Denki Kabushiki Kaisha, Kawasaki, Japan

[22] Filed: Sept. 4, 1975

[21] Appl. No.: 610,238

[52] U.S. Cl. ..... 415/15; 415/17; 290/40 R

[51] Int. Cl.[2] ..... F01B 25/04

[58] Field of Search ..... 415/1, 15, 17; 290/40; 235/151.1

[56] References Cited

UNITED STATES PATENTS

| | | | |
|---|---|---|---|
| 3,340,883 | 9/1967 | Peternel | 415/15 |
| 3,342,195 | 9/1967 | Wagner | 415/15 |
| 3,446,224 | 5/1969 | Zwicky, Jr. | 415/1 |
| 3,452,258 | 6/1969 | Thompson | 415/15 |
| 3,757,130 | 9/1973 | Uchiyama et al. | 415/17 |
| 3,891,344 | 6/1975 | Brayenbah | 415/17 |

*Primary Examiner*—C. J. Husar

*Attorney, Agent, or Firm*—Stevens, Davis, Miller & Mosher

[57] ABSTRACT

A turbine control system for changing two speed governing operations of a steam turbine from a throttle governing operation to a nozzle governing operation and vise versa by controlling steam control valves comprises function generators grouped according to the two speed governing operations and operated by a main control flow-rate request signal to produce function outputs which are applied to respective low-value gate circuits, means for comparing the sum of the outputs of the gate circuits and the main control flowrate request signal, and means for varying the main control flowrate request signal with the aid of the difference between the signals thus compared in such a manner that while one of the outputs of the gate circuits decreases, the other output increases to supplement the decrease, whereby the steam control valves are gradually operated with the output of the turbine being kept unchanged during the operating mode changing operation.

6 Claims, 1 Drawing Figure

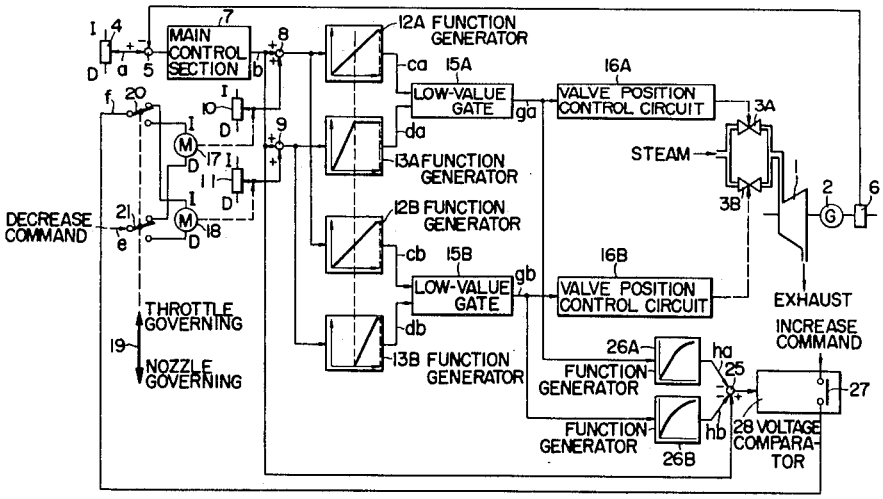

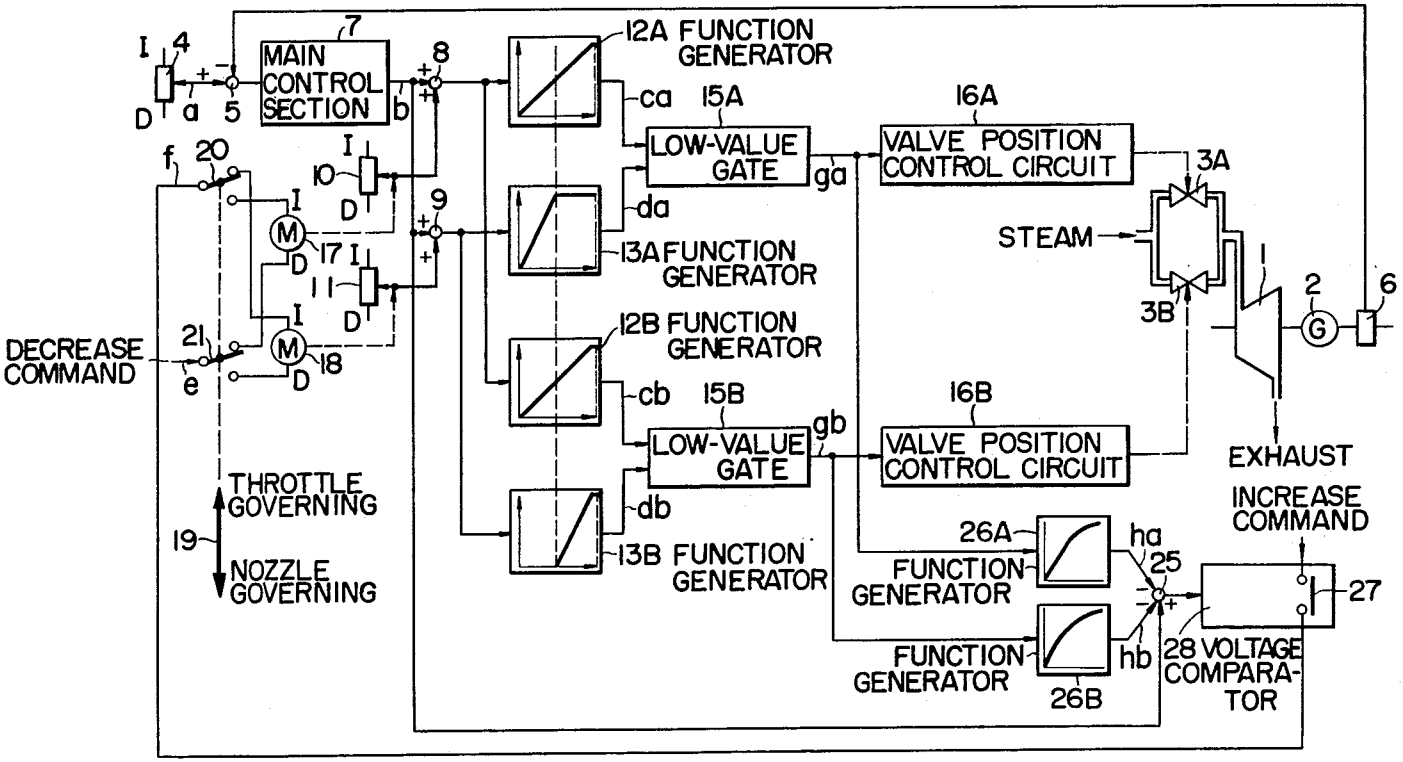
EXHAUST
INCREASE COMMAND
28 VOLTAGE COMPARATOR
27
STEAM
3A
3B
16A VALVE POSITION CONTROL CIRCUIT
16B VALVE POSITION CONTROL CIRCUIT
26A FUNCTION GENERATOR
26B FUNCTION GENERATOR
12A FUNCTION GENERATOR
15A LOW-VALUE GATE
13A FUNCTION GENERATOR
12B FUNCTION GENERATOR
15B LOW-VALUE GATE
13B FUNCTION GENERATOR
7 MAIN CONTROL SECTION
THROTTLE GOVERNING
NOZZLE GOVERNING
DECREASE COMMAND

TURBINE CONTROL SYSTEM

BACKGROUND OF THE INVENTION

This invention relates to an improvement of a turbine control system which controls a turbine provided with a plurality of control valves in an electro-hydraulic control method.

In general, in the control system of a steam turbine, when steam of high temperature and high pressure is introduced from a steam generating device to the steam turbine through a plurality of steam control valves, the flow-rate of the steam is controlled by operating these steam control valves thereby to control the speed and output of the turbine. Especially in starting the turbine, all of the steam control valves are subjected to a so-called "throttle governing control" in which the steam control valves completely closed are gradually opened until the output of the turbine reaches a predetermined value, and thereafter, to a so-called "nozzle governing control" in which the steam control valves are successively fully opened according to the output of the turbine. For this purpose, that is, in order to switch the throttle governing operation over to the nozzle governing operation, conventional steam turbines are provided with control systems for changing the opening degrees of the steam control valves.

In such control system, in order that the steam control valves can provide the desired operating performance of the turbine during its operation, the "opening degree"-"steam flow-rate" characteristic of each steam control valve is corrected with the aid of a main control flow-rate request signal delivered from a speed control section or a load control section so that the opening-degree of each of the steam control valves is changed through a valve position control section to a suitable value.

However, it should be noted that even if one and the same main control flow-rate requesting signal is applied to the turbine, the opening degree characteristic of each steam control valve in the throttle governing operation is different from that in the nozzle governing operation. Accordingly, when the operating condition of the turbine is quickly changed from the throttle governing control condition to the nozzle governing control condition by changing the valve opening degrees, some of the steam control valves abruptly increase their opening-degrees and the steam of high temperature and high pressure rapidly flows into the turbine therethrough, thereby imparting thermal shocks to the nozzle box, the turbine casing, etc., which may cause serious damage to the turbine.

In order to overcome such difficulty accompanying the conventional steam turbines a technique according to U.S. Pat. No. 3,688,095 (corresponding to Japanese Pat. No. 627,126) has been proposed. In this technique, an analog control circuit includes contact means, and therefore its circuit is inevitably intricate, and during the valve opening degree changing operation, the above-described thermal shock is liable to be caused depending on the offsetting conditions of an amplifier and other elements included therein. In this technique, no variation is caused in its steam flow-rate before and after the valve opening degree changing operation; however, during this valve opening degree changing operation the steam flow-rate is varied because no control to keep the steam flow-rate constant is provided. That is, it is impossible to eliminate the variable output of the turbine by the proposed technique.

SUMMARY OF THE INVENTION

Accordingly, an object of this invention is to overcome the above-described difficulties accompanying conventional steam turbine control systems.

More specifically, an object of the present invention is to provide a turbine control system by which, during the speed governing operation changing period of a steam turbine from its throttle governing operation to its nozzle governing operation and vice versa, the opening degrees of its steam control valves are gradually changed in response to the variations of a main control flow-rate request signal in order to positively eliminate the occurrence of thermal impacts; that is, to securely operate the steam turbine.

Another object of the invention is to provide a turbine control system by which during the speed governing operation changing period, the output of the turbine is maintained unchanged.

The foregoing objects and other objects of the invention have been achieved by the provision of a turbine control system for changing two speed governing operations of a steam turbine from a throttle governing operation to a nozzle governing operation and vice versa by controlling a plurality of steam control valves on the basis of a main control flow-rate request signal, which system comprises:

a. a first group of function generators for said throttle governing operation provided respectively for said steam control valves and a second group of function generators for said nozzle governing operation provided respectively for said steam control valves, each function generator producing a function output signal in response to a main control flow-rate request signal applied thereto, b. a low-value gate circuit provided for each steam control valve for selectively passing the lower of the function output signals applied thereto, said lower function output signal thus passed being utilized to control an opening degree of said steam control valve, c. first means for obtaining a difference signal between said main control flow-rate request signal and the sum of said function output signals thus passed, and d. second means for increasing, according to said difference signal, a bias applied to one of said two groups of function generators which operates for one of said two governing operations which is not a speed governing operation intended to effect, and for decreasing a bias applied to the other group of function generators which operates for said speed governing operation intended to effect, whereby during the speed governing operation changing period of said turbine, the output of said turbine is kept unchanged and no thermal shock is caused to said turbine.

The novel features which are considered characteristic of this invention are set forth in the appended claims. The invention itself, however, together with additional objects and advantages thereof will be best understood from the following detailed description taken in conjunction with the accompanying drawing which illustrates, by way of example only, one preferred embodiment of the invention.

BRIEF DESCRIPTION OF THE DRAWING

In the drawing, the single FIGURE is a block diagram showing one example of a turbine control system according to this invention, in which reference characters I and D mean "increase" and "decrease", respectively.

DETAILED DESCRIPTION OF THE INVENTION

One preferred example of a turbine control system according to this invention will be described with reference to the case where as illustrated in FIG. 1, the turbine control system is applied to a steam turbine 1 with two steam control valves 3A and 3B.

The steam turbine 1 is driven, at a speed corresponding to an output *a* set by a speed setting potentiometer 4, by steam introduced through the steam control valves 3A and 3B, thereby to drive an electric generator 2. The output *a* thus set is compared with a speed detection output of a speed detector 6 on the output side of the generator 2 by an adder 5, and depending on the comparison result a main control section 7 provides a main control flow-rate request signal *b* corresponding to the difference between the output *a* and the speed detection output.

The turbine control system further comprises a function generator 12A for the throttle governing operation and a function generator 13A for the nozzle governing operation with respect to the steam control valve 3A. The biases of these function generators 12A and 13A are changed by bias signal setting potentiometers 10 and 11 through adders 8 and 9, respectively. Furthermore, a function generator 12B for the throttle governing operation and a function generator 13B are provided with respect to the second steam control valve 3B, and the biases of the function generators 12B and 13B are changed by the potentiometers 10 and 11 through the adders 8 and 9, respectively.

The throttle governing function generators 12A and 12B receive, as abscissa inputs, the main control flow-rate request signal *b* through the adder 8 from the main control section 7, and produce ordinate outputs, that is, opening-degree command signals *ca* and *cb*, respectively. Similarly as in above-described function generators, the nozzle governing function generators 13A and 13B receive, as their abscissa inputs, the main control flowrate request signal *b* through the adder 9 from the main control section 7, and produce ordinate outputs, that is, opening-degree command signals *da* and *db*, respectively.

The outputs *ca* and *da* of the function generators 12A and 13A thus produced are applied to a low-value gate circuit 15A which operates to produce as its output the lower of the two inputs applied thereto. Therefore, the lower of the outputs *ca* and *da* applied to the preference circuit is introduced to a first valve position control circuit 16A connected to the first control valve 3A. Similarly as in the case described above, the outputs *cb* and *db* of the function generators 12B and 13B provided for controlling the second control valve 3B are applied to a low-value gate circuit 15B, and the lower output of the two outputs *cb* and *db* is introduced to a second valve position control circuit 16B provided for the second control valve 3B.

The sliders of the potentiometers 10 and 11 are moved and by their respective driving motors 17 and 18 which are operated in opposite direction by change-over switches 20 and 21 each having two positions, namely, a throttle governing position and a nozzle governing position. These change-over switches 20 and 21 are operated by an operating lever or switch 19 adapted to change over the throttle governing operation and the nozzle governing operation of the turbine.

More specifically, when the armature of the switch 21 is tripped to the throttle governing position (the nozzle governing position), a decrease command signal e is applied to the driving motor 17 (18) so that the biases of the function generators 12A and 12B (13A and 13B) are changed so as to decrease the opening degrees of the steam control valves 3A and 3B. On the other hand, when the armature of the switch 20 is tripped to the throttle governing position (the nozzle governing position), an increase command signal *f* is applied to the driving motor 18 (17) so that the biases of the function generators 13A and 13B (12A and 12B) are changed so as to increase the opening degrees of the steam control valves 3A and 3B.

The increase command signal *f* is obtained on the basis of the sum of the outputs of the low-value gate circuits 15A and 15B with respect to the magnitude of the main control flow-rate request signal *b* of the main control circuit 7. More specifically, the outputs *ga* and *gb* of the gate circuits 15A and 15B are applied, as abscissa inputs, to function generators 26A and 26B, which produce flow-rate signals *ha* and *hb* as ordinate outputs, respectively. The flow-rate signals *ha* and *hb* thus produced are applied, as subtraction inputs, to an adder 25, while the above-described signal *b* is applied, as an addition input, to the adder 25. The output of the adder 25 is applied to a voltage detector or a voltage comparator 28 comprising an output contact means 27. When the input to the voltage comparator is positive (that is, the signal *b* is greater than the sum of the flow-rate signals *ha* and *hb*) the output contact means 27 is closed, and through the output contact means 27 thus closed, the above-described increase command signal *f* is applied to the change-over switch 20.

Consider that the steam turbine is in the turbine governing operation, and the main control flow-rate request signal *b* is for a half of the rated flow-rate of the turbine. In this operation, the slider of the potentiometer 11 is at its maximum output position in the increase direction, and therefore a bias corresponding to the rated flow-rate request signal in this case is applied to the adder 9 by the potentiometer 11. Accordingly, the function generators 13A and 13B generate valve-full-opening signals, respectively. In this case, the outputs *ca* and *cb* of the function generators 12A and 12B are lower than the valve-full-opening signals, and are therefore applied through the gate circuits 15A and 15B to the valve position control circuits 16A and 16B, respectively. Thus, the steam control valves 3A and 3B are controlable by the function generators 12A and 12B, respectively.

On the other hand, the slider of the potentiometer 10 is at the minimum output position in the decrease direction, and therefore a bias corresponding to the zero flow-rate request signal is applied to the adder 8, that is, no bias is applied to the adder 8. Accordingly, the function generators 12A and 12B produce valve openingdegree signals according to the main control flow-rate request signal not biased, to control the steam control valves 3A and 3B, respectively. Thus, the steam turbine is operated in the regular throttle governing operation. Under this condition, the adder 25 produces no output.

In order to change the throttle governing operation of the turbine to the nozzle governing operation, the armatures of the change-over switches 20 and 21 are tripped to the respective nozzle governing positions. As a result, the decrease signal *e* is applied through the switch 21 to the driving motor 18, and the motor 18 is driven at a predetermined speed. Accordingly, the slider of the potentiometer 11 is slowly moved in the decrease direction, and in response to this movement the bias to the flow-rate request signal *b* is gradually reduced.

As is apparent from function output characteristic curves shown in the blocks of the function generators 13A and 13B, when the inputs to the function generators 13A and 13B decrease, the output of the function generator 13B decreases immediately, while the output of function generator 13A is maintained unchanged until the input applied thereto decreases to a predetermined value, although the output of the function generator decreases as the input thereto becomes lower than the predetermined value.

Accordingly, after the bias to the flow-rate request signal has started to decrease through the operation of the potentiometer 11 as was described above, first the output *db* of the function generator 13B becomes lower than the output *db* of the function generator 12B. Therefore, the output of the function generator 13B passes through the gate circuit 15B.

Under this condition, the output *gb* of the gate circuit 15B is lower than its initial value, and therefore the sum of the subtraction inputs to the adder 25 from the function generators 26A and 26B becomes lower than the initial sum. Therefore, the output of the adder 25 becomes positive, and the output contact means 27 of the voltage comparator 28 is closed, whereupon the increase command signal *f* is introduced to the change-over switch 20 through the contact means 27 thus closed, so as to drive the motor 17. Accordingly, the slider of the potentiometer 10 is moved in the increase direction. As a result, the bias to the adder 8 is increased, and in response to this increase, the outputs of the function generators 12A and 12B increase.

When the increase of the output of the function generator 26A has supplemented the decrease of the output of the function generator 26B, the output of the adder 25 becomes zero. Resultantly, the output contact means 27 of the voltage comparator 28 is opened, and therefore the operation of the motor 17 to correctively move the position of the slider of the potentiometer 10 is suspended.

On the other hand, the movement of the slider of the potentiometer 11 in the decrease direction is still continued to decrease the bias to the adder 9. However, in response to this movement of the slider of the potentiometer 11, the above-described correction operation of the motor 17 is conducted so as to increase the bias to the adder 8. When the bias to the adder 9 becomes zero, the bias to the adder 8 becomes corresponding to the rated current request signal. As a result, the low-value gate circuits 15A and 15B pass now only the outputs of the function generators 13A and 13B, respectively. Thus, the nozzle governing operation of the steam turbine has been attained.

As is apparent from the above description, it can be achieved, according to this invention, by tripping the armatures of the change-over switches 20 and 21 to smoothly change the throttle governing operation of the steam turbine to the nozzle governing operation.

More specifically, since the operating modes of the steam turbine are switched over by the gate circuits according to the invention, the opening degrees of the steam control valves can be gradually changed, and during the period of changing the valve opening degrees the flow rate of steam introduced into the turbine is controlled constant; that is, the occurrence of the thermal impact described before can be prevented.

Furthermore, the closed loop for controlling the speed of the turbine, including the main control section, the valve position control system and the speed difference detecting section, is kept operable at all times, that is, before, during, and after the operating mode changing operation. Therefore, even if an emergency such as load interruption is caused, it will not excessively increase the speed of the turbine; that is, the operation of the turbine can be safely continued.

The invention has been described with respect to the case where the operating mode of the turbine is changed from the throttle governing operation to the nozzle governing operation under the operating condition of the ½ rated flow-rate request signal; however, it is understood that the invention is not limited thereto or thereby. That is, similarly as in the above-described case, the operating mode change operation without the thermal impact can be achieved also when the main control flow-rate request signal is greater or smaller, or the operating mode of the turbine is changed from the nozzle governing operation to the throttle governing operation.

Furthermore, in the above description the sum of the output *ha* and *hb* of the function generators 26A and 26B representative of the total steam flow-rate of the steam control valve is subtracted from the main control flow-rate request signal *b*, but this sum of the outputs *ha* and *hb* may be substituted by a signal proportional to the mechanical output of the turbine. For instance, the first stage pressure, or the intermediate stage pressure in the high pressure casing of the turbine can be employed as the signal proportional to the mechanical output of the turbine. In addition, the addition of the outputs of the function generators 26A and 26B may be substituted by the conversion of the output signal of the electric generator.

Furthermore, in the above description, the main control flow-rate request signal *b* is employed as a basis for the adder 25 to operate the voltage comparator 28; however, the sum of the outputs of the function generator 26A and 26B, the fitst stage pressure and the intermediate stage pressure in the high pressure casing of the turbine and the generator output signal before the mode changing operation can be utilized as the bias so that, during the mode changing operation, the output of the electric generator or the output of the turbine is not varied.

We claim:

1. A turbine control system for changing two speed governing operations of a steam turbine from a throttle governing operation to a nozzle governing operation and vice versa by controlling a plurality of steam control valves on the basis of a main control flow-rate request signal, which system comprises:

a. a first group of function generators for said throttle governing operation provided respectively for said steam control valves and a second group of function generators for said nozzle governing operation provided respectively for said steam control valves, each function generator producing a function output signal in response to a main control flow-rate request signal applied thereto, b. a low-value preference circuit provided for each steam control valve for selectively passing the lower of the function output signals applied thereto, said lower function output signal thus passed being utilized to control an opening degree of said steam control valve, c. first means for obtaining a difference signal between said main control flow-rate request signal and the sum of said function output signals thus passed, and d. second means for increasing, according to said difference signal, a bias applied to one of said two groups of function generators which operates for one of said two governing operations which is not a speed governing operation intended to effect, and for decreasing a bias applied to the other group of function generators which operates for said speed governing operation intended to effect, whereby during the speed governing operation changing period of said turbine, the output of said turbine is kept unchanged and no thermal shock is caused to said turbine.

2. A turbine control system as claimed in claim 1 in which said first means comprises a. a third group of function generators connected to said low-value gate circuits for receiving said function output signals passed therethrough to produce flow-rate signals, respectively, and b. an adder connected to said two function generators for adding said flow-rate signals from said two function generators to said main control flow-rate request signal, thereby to produce said difference signal if there is a difference between the sum of said flow-rate signals and said main control flow-rate request signal.

3. A turbine control system as claimed in claim 2 in which said first means further comprises detection means connected to said adder for detecting said difference signal to control the operation of said second means.

4. A turbine control system as claimed in claim 1 in which said second means comprises:

a. first and second change-over switches which are operated according to said speed governing operations, the first one receiving an increase command signal introduced according to said difference signal, the second one receiving a decrease command signal, b. two driving motors which are driven in opposite direction through said change-over switches, respectivly, c. first and second bias signal setting potentiometers respectively connected to said driving motor and to said two groups of function generators through two adders, the slides of said potentioimeters being moved by said driving motors to provide bias signals for varying said main control flow-rate request signal applied to said first and second groups of function generators.

5. A turbine control system as claimed in claim 4 in which said second means further comprises a first adder connected to said first group of function generators to receive said main control flow-rate request signal and said bias signal from said first potentiometer thereby to vary the main control flow-rate request signal applied to said first group of function generators, and a second adder connected to said second group of function generators to receive said main control flow-rate request signal and said bias signal from said second potentiometer thereby to vary the main control flow-rate request signal applied to said second group of function generators.

6. A turbine control system as claimed in claim 2 in which function output characteristics of said first and second groups of function generators are such that as one of said flow-rate signals from said third group of function generators decreases, the other flow-rate signal increases to supplement the decrease.

* * * * *